US005535566A

United States Patent [19]

Wilson et al.

[11] Patent Number: 5,535,566

[45] Date of Patent: Jul. 16, 1996

[54] CONCEALED GRID CEILING PANEL SYSTEM

[75] Inventors: Wm. S. Wilson, Milton; Heikki Kolga, Islington; Ronald G. White, Holland Landing, all of Canada

[73] Assignee: Decoustics Limited, Etobicoke, Canada

[21] Appl. No.: 439,501

[22] Filed: May 11, 1995

Related U.S. Application Data

[63] Continuation-in-part of Ser. No. 95,338, Jul. 23, 1993, Pat. No. 5,428,930.

[51] Int. Cl.[6] ..... E04B 9/26

[52] U.S. Cl. ..... 52/506.07; 52/489.1; 52/98; 52/393; 52/766; 52/769; 52/774; 52/677

[58] Field of Search ..... 52/395, 396.1, 52/396.04, 393, 489.1, 506.07, 506.09, 712, 774, 717.06, 685, 686, 696, 461, 716.6, 716.7, 766, 769, 677; 24/295

[56] References Cited

U.S. PATENT DOCUMENTS

| | | | |
|---|---|---|---|
| 1,997,580 | 4/1935 | Gibson et al. | 52/506.09 X |
| 3,612,461 | 10/1971 | Brown | 52/506.07 X |
| 3,864,789 | 2/1975 | Leitner | 52/716.7 X |
| 4,041,668 | 8/1977 | Jahn et al. | 52/506.09 |
| 5,265,393 | 11/1993 | Bischel et al. | 52/DIG. 8 X |
| 5,428,930 | 7/1995 | Bagley et al. | 52/506.07 |

*Primary Examiner*—Carl D. Friedman
*Assistant Examiner*—Robert J. Canfield

[57] ABSTRACT

A concealed suspension ceiling system advantageously uses a 'T' bar grid network used for lay-in ceiling panels. Saddle clips are secured to upper beads of the 'T' bar grid network allowing torsioning springs to releasably maintain the panels suspended beneath the grid. The system can be used for entirely new installations or used in a retrofit application.

12 Claims, 4 Drawing Sheets

CONCEALED GRID CEILING PANEL SYSTEM

This application is a continuation-in-part of Ser. No. 08/095,338 filed Jul. 23, 1993, now U.S. Pat. No. 5,428,930.

FIELD OF THE INVENTION

The present invention relates to ceiling panel systems.

BACKGROUND OF THE INVENTION

One of the most common ceiling panel systems is a 'T' bar ceiling panel system where panels are supported by an exposed 'T' bar grid network. There are many manufacturers of 'T' bar systems and the individual ceiling panels are received above lower flanges of the inverted 'T' bar members which form a frame about the panel. In this type of system, the lower flanges of the 'T' members are visible. A number of systems are available for defining what is referred to as a concealed grid system. In concealed grid systems, the panels typically abut and hide the support grid network. Most of these systems use torsion springs to initially support the panels at a first position spaced significantly below the grid system with the panels being movable to a second position with the panels in engagement with the grid network. The torsion springs maintain the panels in tight engagement with the lower surface of the grid network. Examples of ceiling panel systems are shown in U.S. Pat. Nos. 4,438,613 and 4,548,010.

Due to the extreme popularity of 'T' bar ceiling systems, installers are intimately familiar with these systems and can quickly install a grid network. Furthermore, there are a very large number of buildings which have such grid networks already in place which can be used by the present invention as a concealed grid support network.

SUMMARY OF THE INVENTION

A ceiling system, according to an aspect of the present invention, comprises ceiling panels designed to abut adjacent ceiling panels and collectively define a concealed grid ceiling panel system. A 'T' bar grid system, of a type used in 'T' bar ceiling panel systems used to support ceiling panels above a lower edge of the grid system, is used for defining the grid system for the panels of the concealed grid ceiling system. Panel suspension clip members are secured at top edges of the 'T' bar grid system and extend to at least one side of the respective 'T' bar member and engage a torsion spring to the side of the respective 'T' bar member. The torsion spring and a lower edge thereof engages a ceiling panel edge and positively supports the ceiling panel beneath the grid. Each ceiling panel includes at least two torsion springs which cooperate to support the ceiling panel immediately beneath the grid, with the top edge of the ceiling panel engaging the lower flanges of the grid system. Preferably, each ceiling panel is supported by four torsion springs located adjacent the corners of the panels.

It is also possible to use the arrangement, but not fully conceal the grid network. In this case, panels still contact the bottom flange of the grid network and all panels do not necessarily abut, thereby exposing a reduced portion of the lower flange of the 'T' bar members.

According to a preferred aspect of the invention, alignment means are secured at a desired position, preferably centrally on the lower flange of the 'T' bar members, and this alignment means cooperates with the edges of the panel to align the ceiling panels with the grid network.

According to a further preferred aspect of the invention, the panel suspension clip members are combined, such that each panel suspension clip member receives a torsion spring of abutting opposed panels positioned either side of the 'T' bar member of the grid network. According to yet a further aspect of the invention, the panel suspension clip members are located at the junctions of the grid network and opposed clip members are combined. Preferably, these combined panel suspension clip members reinforce the junction of the grid network.

A panel suspension clip, according to the present invention, for use in a suspended ceiling system comprises a first segment and a second segment interconnected by a rigid frangible bridge segment. Each of the first and second segments comprise a top downwardly opening channel for straddling an upper bead of the 'T' bar grid members, with extension flanges either side of the channel. Each flange has a slot therein designed to engage and retain a torsion spring.

According to a further aspect of the invention, the panel suspension clips include a mechanical means for positively securing the clip to the 'T' bar grid member. A 'U' shaped channel is sized to be placed over the bead of a 'T' bar member and then pinched thereon by the prechemical fastener. This results in reinforcing of the 'T' bar member.

According to yet a further aspect of the invention of the panel suspension clip, the frangible bridge segment is positioned to overlie the upper bead of a 'T' bar grid member. This bridge segment spaces the first and second segments sufficiently to accommodate a cross member forming a junction with a main 'T' of the 'T' bar grid system.

The invention is also directed to a combination comprising the 'T' bar grid system, panel suspension clips and ceiling panels. The 'T' bar grid system comprises main 'T' s and cross 'T' s forming the grid system. Each panel suspension clip is secured to the grid system at a junction of the grid system and positions a first segment of the clip on a main 'T' to one side of a cross 'T' and positions the second segment of the panel suspension clip on the main 'T' to the opposite side of the cross 'T'. The ceiling panels include torsion springs for suspending of the panels from the panel suspension clips. The torsion springs are received in slots of the panel suspension clips and the ceiling panels are sized to generally align corners of the ceiling panels beneath a junction of a main 'T' and cross 'T' with a panel suspension clip positioned to receive and engage a torsion spring of the ceiling panel. The ceiling panels preferably abut and collectively conceal the grid network from below.

According to a preferred aspect of the combination, panel suspension clips are grouped in pairs, with the clips of the pair being located on a main 'T' and to either side of a cross 'T' with the panel suspension clips of a pair being interconnected by a frangible bridge segment.

A method according to the present invention replaces a 'T' bar grid and panel ceiling system with a concealed grid ceiling system. The method comprises removing the panels of the 'T' bar ceiling system to fully expose the 'T' bar grid, panel suspension clips at an upper edge of the 'T' bar grid system, and positioning of the clips for edge support of the ceiling panels. The panel suspension clips have slots either side of the 'T' bar grid for engaging torsion springs, and torsion springs are brought into engagement with the clips. Prior to this engagement, the torsion springs are hingedly secured to the ceiling panels in a manner to accommodate horizontal suspension of the ceiling panels beneath the 'T' bar grid. The above generally defines a downwardly accessed ceiling panel system. The method includes initially suspending the ceiling panels in a generally horizontal position beneath the 'T' bar grid by securing of the torsion springs in the panel suspension clips, with the spacing of the clips on the 'T' bar grid corresponding to the spacing of the springs when secured on a ceiling panel. The panels are then forced upwardly to contact the lower surface of the 'T' bar grid system, with the torsion springs also moving upwardly through the slots of the clips and maintaining the ceiling panels immediately below the 'T' bar grid. The panels, when secured beneath the 'T' bar grid, abut and conceal the 'T' bar grid.

According to a preferred aspect of the invention, the ceiling panels are sized to correspond to a multiple of the cell size of the 'T' bar grid.

The invention is also directed to an alignment clip designed to be retained on the lower flange of a 'T' member and provide a centrally disposed alignment flange projecting from the lower flange. The alignment flange serves to engage an edge of a ceiling panel and align contacting ceiling panels beneath the grid.

In a preferred embodiment, the alignment clip is shaped to space the ceiling panels beneath the grid a predetermined distance providing a narrow tool gap therebetween whereby the top surface of the ceiling panel can be engaged to assist in downward removal of a ceiling panel.

In a further aspect of the invention, the alignment clip is designed to accommodate different 'T' bar grid where the width of the lower flange varies. The alignment clip has wall sections which distort to accommodate variations in the width of a lower flange of a 'T' bar member.

According to a preferred aspect, the alignment flange is of a double thickness and spreads to accommodate increase in widths of the flange of a 'T' bar member.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
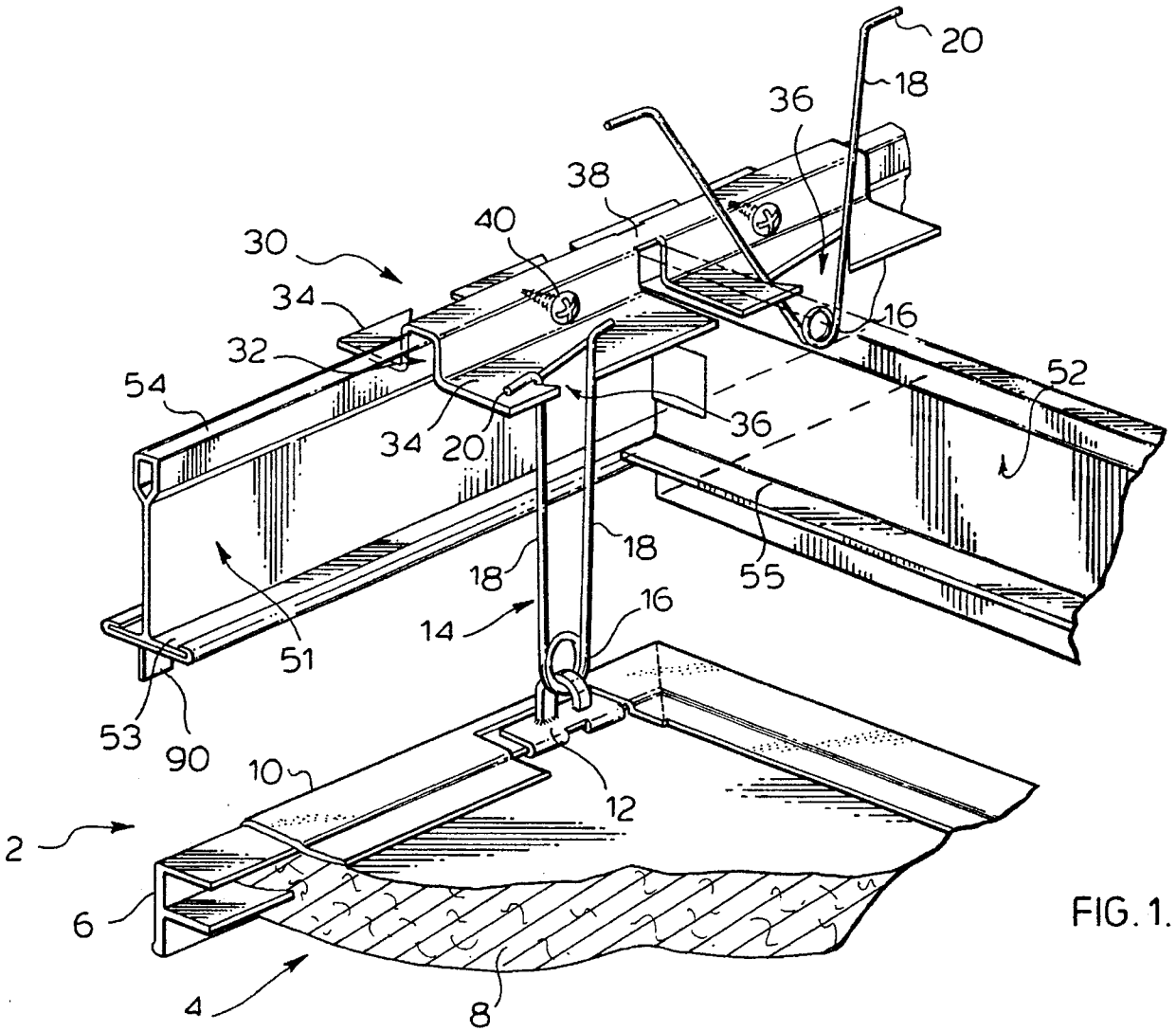
FIG. 1 is a partial perspective view of a concealed grid ceiling system according to the present invention.

The suspended, downwardly accessible, concealed grid ceiling system 2, shown in FIG. 1, is defined by combining the ceiling panels 4, the 'T' bar grid network 50, saddle panel suspension clips 30, and torsion springs 14. The ceiling panels 4 have a framed periphery 6 surrounding a body member 8 typically of an acoustical dampening material or other material. Preferably, the ceiling panels are covered by a fabric or other decorative covering or finishing material 10. The panels include, adjacent the corners thereof, torsion spring engaging clips 12 which trap the top flange of the framed periphery 6 in a 'U' shaped slot. The wound portion 16 of the torsion spring is engaged by the clip 12 and connects the torsion spring to the ceiling panel to allow suspension thereof beneath the grid network 50. The torsion spring includes spring arms 18 which engage the saddle clips 30 at various points along the length of the spring arms. Each spring arm includes a retaining foot 20 at a distal end thereof.

The saddle clip 30 has a downwardly opening channel 32 for straddling the upper bead 54, preferably of a main 'T' shown as 51. The upper bead 54 of different 'T' bar grid systems can vary somewhat, but are of a similar width whereby a single size of the downwardly opening channel 32 is suitable for the common suppliers of 'T' bar grid systems, particularly when a screw type fastener is used to secure the saddle clip to the bead. In order to provide positive locking of the saddle clip 30 to a main 'T' 51 or a cross 'T' 52, a mechanical fastener, in this case a releasable mechanical fastener 40 in the form of a metal sheet screw, locks the saddle clip to the upper bead 54.

Figure 8:
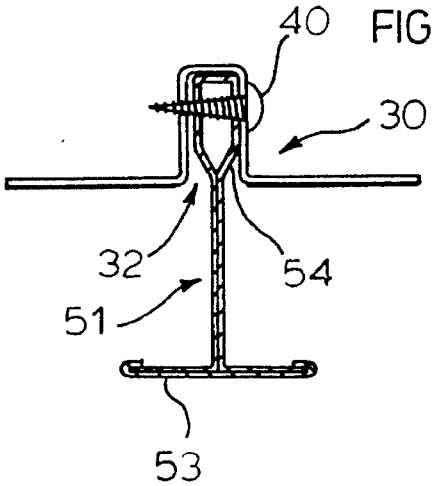
FIG. 8 is an end view showing securement of the saddle clip to the bead of a main 'T' member.

The securement of the saddle clip 30 to the upper head 54, as shown in FIGS. 1 and 8, uses the saddle clip to reinforce the main 'T' member 51. The screws 40 pass through the bead 54 and positively engage the channel 32, drawing it into snug engagement with the bead 54. In this way, the saddle panel suspension clip 30 reinforces the grid member, provides positive placement and engagement with spring clips for suspending ceiling panels beneath the grid, and can accommodate variations in the bead width. Different manufacturer's of 'T' bar grid systems can have lower flanges and upper beads of somewhat different dimensions. The channel of the saddle clip provides positive securement and reinforcement grid members of different manufacturers.

The saddle clip of FIG. 1 has been shown in a paired orientation with an adjacent saddle clip, with a frangible bridge segment 38 securing the saddle clips. Each of the saddle clips include horizontal projecting flanges 34 either side of the downwardly opening channel and these flanges include slots for receiving torsion springs and releasably engaging the torsion springs. This provides a simple arrangement for securing of a ceiling panel beneath the 'T' bar grid system. One such panel **4*a* is shown in FIG. 1 and it can be seen that the ceiling panel 4 is in abutting engagement with the lower flange 53 of the main 'T' and the lower flange 55 of the cross 'T' 52 and is held in this position due to the torsion spring 18. Four such torsion springs would be provided at the corners of each rectangular panel. Alignment clips 90** can be secured centrally on the lower edge of the 'T' bar members and cooperate with the edges of the ceiling panels to align the ceiling panels with the 'T' bar members.

The 'T' bar grid system, generally shown as 50, is typically of a rectilinear grid configuration and there are a host of 'T' bar grid systems presently installed in buildings. These existing grid systems can be used in a retrofit application to provide a suspended ceiling panel system. Depending upon the type of panels being installed, the structural integrity of the grid may also have to be checked. By using the existing grid system, a time and cost benefit may be realized. This system has significant advantages even in new installations, in that installers have extensive experience with respect to installing of 'T' bar grid systems and often have fairly sophisticated equipment to carry this out quickly. Therefore, savings can be gained due to less time required to install the system. Furthermore, specialized grid networks can be provided, and again, there would be some savings in installation due to the ability of the installer to use a system with which he is already familiar. It can be appreciated that there is also an economy of scale in using a relatively high volume grid network as well as a marketplace which is very price competitive with respect to these type of grid networks. These advantages are possible by designing other components to work with these systems.

Figure 2:
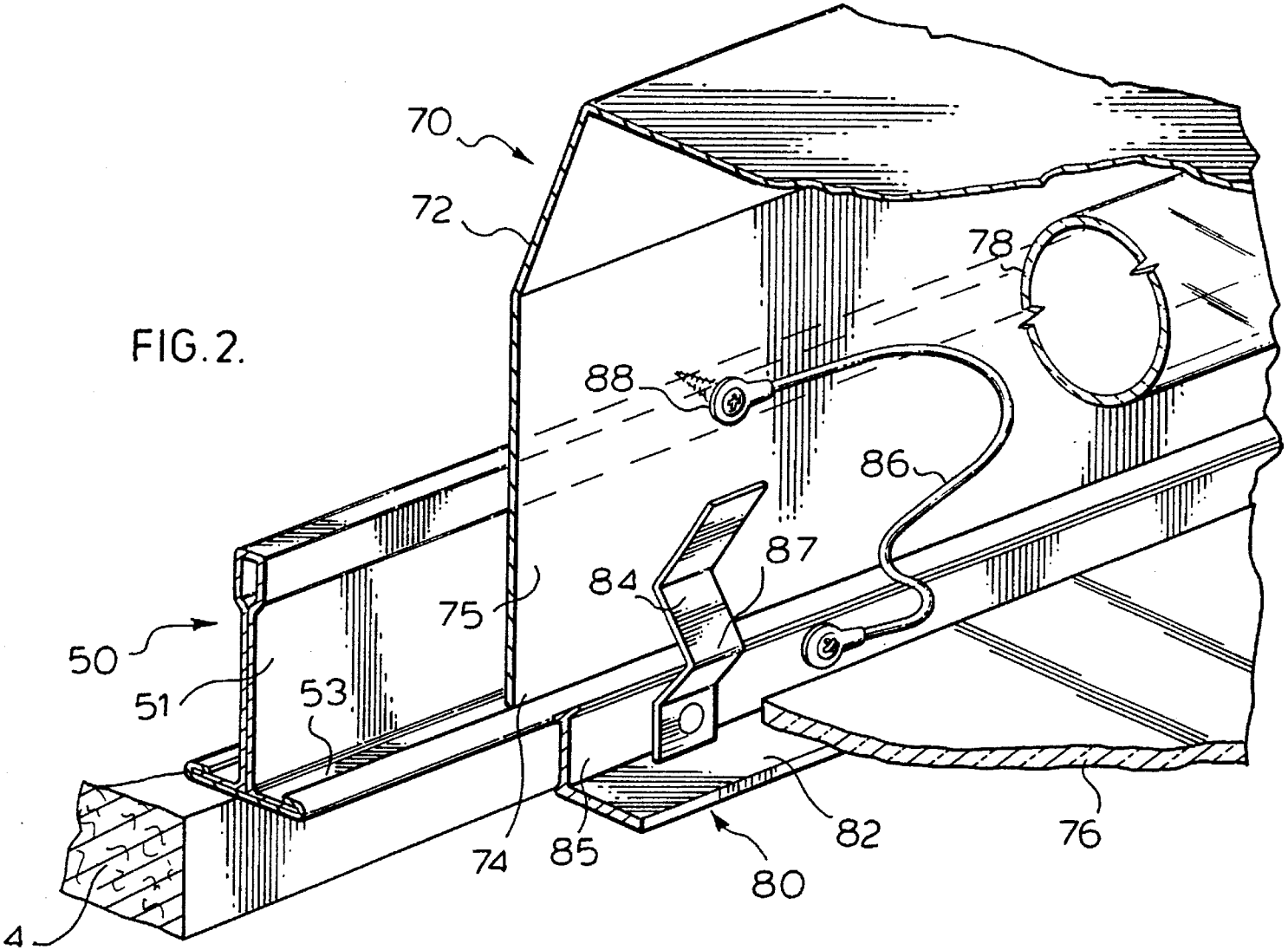
FIG. 2 is a partial perspective view showing the detail of conversion of a light fixture in an existing 'T' bar system to be flush with the bottom of the concealed grid ceiling system.

FIG. 2 shows details of an arrangement for extending a light fixture to the level of the ceiling of the suspended ceiling system. The actual height of the ceiling has been lowered due to suspension of the panels below the grid network. A light fixture 70 having a shell 72 is supported by the 'T' bar grid system 50, and in particular by the lower edge 74 of the light fixture being supported by the bottom flange of the main 'T' 51. This is the typical arrangement for a fluorescent light fixture in a 'T' bar grid system and the fluorescent tube of the light fixture is generally shown as 78. The light fixture also includes a lens 76 which typically would be supported above the bottom flange of the main 'T' 51 and possibly the bottom flange of the cross 'T's, which are not shown. Thus, the lower surface of the light lens generally corresponds with the level of the lower edge 74 of the light fixture 70. To overcome this problem, a rectangular frame 80 is provided which corresponds to the bottom opening of the light fixture. This rectangular frame is held by spring clips 84 below the lower edge of the light fixture. The free edge of the vertical member 85 is in contact with lower flange 53 of the 'T' bar and serves to space the member the appropriate distance below the 'T' bar. The spring clip 84 engages the side walls 75 of the light fixture with the 'L' shaped recess 87 acting as a cam locating surface with one edge of flange 53.

Typically, four spring clips are provided, one adjacent each corner of the rectangular frame 80, to positively support the frame beneath the light fixture. The frame is at the level of the concealed grid ceiling system due to the vertical arm of the frame being in contact with the bottom flange of the 'T' bar. The lens 76, rather than being supported by the lower flange of the 'T' bar, is now supported by the lower flange 82 of the rectangular frame 80. The lens member may merely be angled and inserted into the light fixture and eventually supported by the lower flange 82 of the rectangular frame. The frame can also be lowered and the lens put in or the light fixture serviced.

Prior to installing of the lens 76, safety cable 86 may be positively secured to the light fixture by the screw 88. Several safety cables 86 may be provided to positively retain the frame beneath the light fixture. This may be required to satisfy certain safety or fire codes.

The present system, although suitable for retrofit applications, can also be used for new installations. The 'T' bar can be installed with only about 7½ inches clearance above, as opposed to about 12 inches if a normal 'T' bar and lay-in panel system was used. The reduced space is a result of the downward access of the system.

The actual size of the panels can vary, in that the saddle clips preferably are supported by main T's. This allows the other dimension to vary. Furthermore, additional cross 'T's are easily inserted, if needed. The present system is economical, easily installed and flexible with respect to variation in panel size.

In some circumstances it may be desirable to leave existing ceiling panels in place to provide additional sound insulation. In this case, portions of the existing panels can be removed to allow the torsion springs to pass therethrough. These panels can be easily modified by the installers if it is desirable to maintain the former ceiling, although it will be fully concealed by the new ceiling suspended therebelow.

FIGS. 3 through 8 show additional details of the preferred alignment clip 100 as well as the preferred securement of the saddle clip to the main 'T'.

The alignment clip 100 has a double thickness alignment flange 102 which has been folded upon itself, a retaining edge channel 104 for engaging one edge of a main 'T' and a combination cam retaining edge 106 for engaging the opposite edge of the 'T'. The alignment clip also includes spacing channels 108 which serve to space the ceiling panel below the lower flange 53 and which are also capable of distorting to accommodate lower flanges of slightly increased width.

Figure 3:
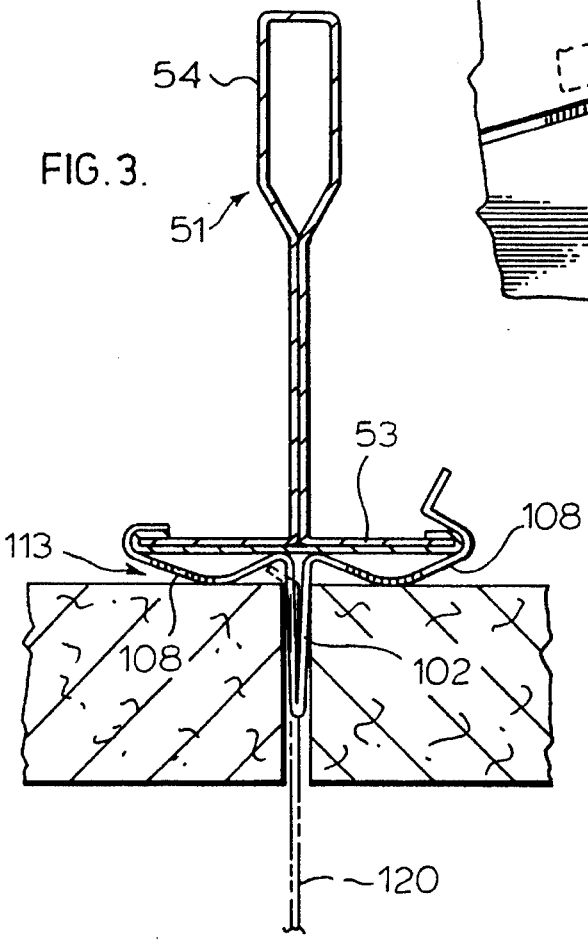
FIG. 3 is an end view showing a main 'T' having the alignment clip fastened to the lower flange with two panels in final suspended position beneath the main 'T' member.

As shown in FIG. 3, the spacing channels 108 are provided either side of the alignment flange 102 and engage the back surface of the ceiling panels, generally shown as 4. Thus, a gap 113 is provided between the lower surface of the flange 53 and the upper surface of the ceiling panels 104. This spacing allows a tool, generally shown as 120, with a hooked edge 122 for passing between two ceiling panels and engaging the top surface of the ceiling panels with the hook member 122 to allow a downward force to be applied to the ceiling panel for removal of the ceiling panel.

Figure 5:
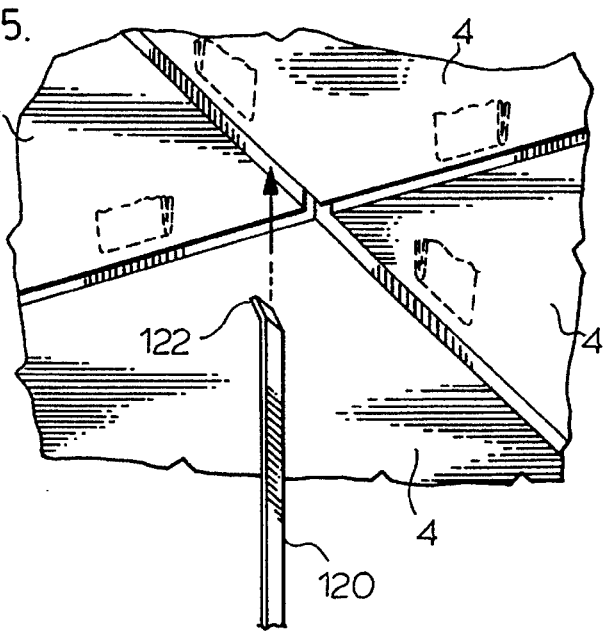
FIG. 5 shows four ceiling panels in suspended position and aligned by the alignment clips.

As shown in FIG. 5, four alignment clips 100 are provided adjacent a junction of a main 'T' and cross 'T' with two alignment clips being applied to the main 'T' and two alignment clips being applied to opposed cross 'T's. These alignment clips engage the side edges of the panel, as shown in FIG. 3, and align the panels 4 beneath the grid members. A narrow gap is provided between the two panels and the panels serve to hide the grid system.

Figure 4:
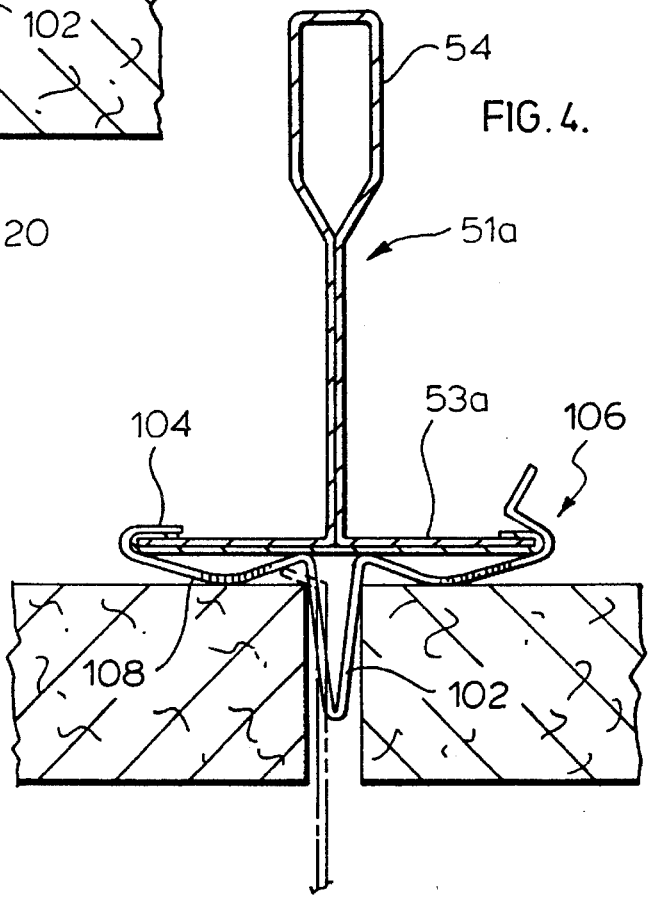
FIG. 4 is an end view showing the alignment clip on a main 'T' member where a main 'T' member has an extended lower flange.

FIG. 4 shows a main 'T' 51*a* having a lower flange 53*a* which is of greater width. In order to accomplish this greater width, the spacing channels 108 have flattened somewhat and in addition, the alignment flange 102 has spread to thereby allow the clip to engage the larger flange and be centered thereon. Thus, the alignment clip appropriately distorts to accommodate variations in the width of the lower flange 53 of a main grid member or a cross 'T' member while keeping alignment flanged centered. This is significant in that different manufacturers of 'T' bar grid do have somewhat different dimensions and the alignment clip can accommodate variations in dimension of the lower flange of the 'T' bar members.

Figure 7:
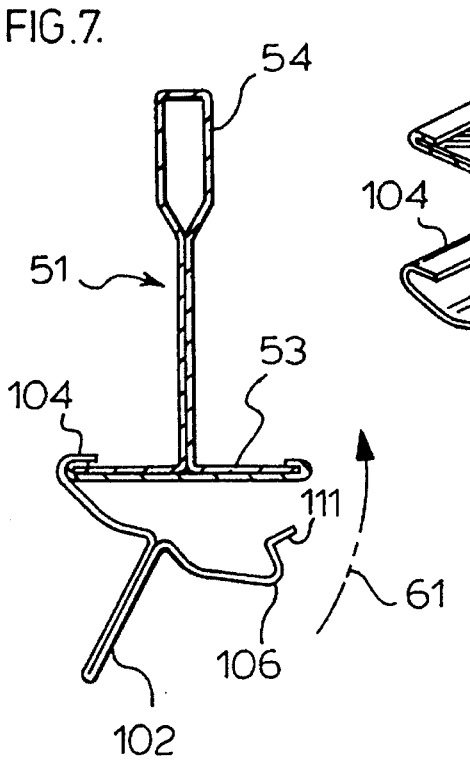
FIG. 7 is an end view showing securement of the alignment clip to the main 'T' member.
Figure 6:
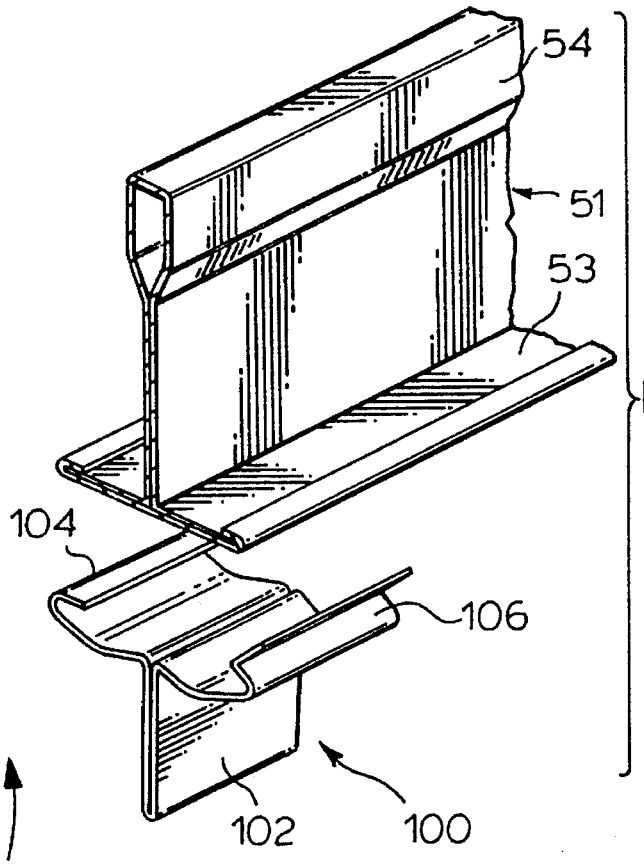
FIG. 6 is a partial perspective view showing the alignment clip add main 'T' member.

FIGS. 6 and 7 show further details of the alignment clip, and in particular show securement of the alignment clip to the lower flange 53. As can be seen, the retaining edge channel 104 of the clip engages one side of the lower flange 53 of the main 'T' 51 and the clip is then moved upwardly, as indicated by arrow 61. This brings the camming surface 111 into engagement with the opposed edge of the flange 53 and further movement of the spring clip allows the camming member to move past the edge to firmly engage the flange and to align the alignment flange 102 beneath the center of main 'T' bar 51 or a cross 'T' bar.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. In combination, a 'T' bar grid system, securing clips and ceiling panels, said 'T' bar grid system comprising main T's and cross T's forming the grid system, each securing clip being secured to said grid system at a junction of the grid system and positioning a first segment of said clip on a main T and to one side of a cross T and positioning a second segment of the securing clip on the main T to the opposite side of said cross T, said ceiling panels including torsion springs for suspending thereof from said securing clips, said torsion springs being received in slots of said securing clips, said ceiling panels being sized to generally align corners of the ceiling panels beneath a junction of a main T and cross T, with a securing clip positioned to receive and engage a torsion spring of a ceiling panel, said ceiling panels abutting and collectively covering the grid system from below, said main T's and cross T's having a plurality of alignment clips secured to a lower surface of said main and cross T's, said alignment clips cooperating with said panels to align the panels beneath the 'T' bar grid system with adjacent panels spaced by at least one alignment clip; each alignment clip comprising a first channel engaging a flange edge of a grid, a second channel opposite said first channel engaging an opposing flange edge of the respective grid, and an alignment flange centrally disposed between said first and second channels engaging and centering adjacent ceiling panels, each alignment clip including curved segments which accommodate separation of said first and second channels while maintaining said alignment flange centered between said channels; wherein each of said channels is separated from said alignment flange by curved segments which project downwardly relative to said channels and provide a ceiling panel stop surface separated from the lower surface of a grid by a tool gap into which a hooked tool can pass and engage an upper surface of a ceiling panel secured therebelow.

2. In combination as claimed in claim 1 wherein said first and second segments are interconnected by a frangible bridge segment.

3. In combination as claimed in claim 1 wherein said securing clips are each mechanically fastened to a main T of the grid system.

4. In combination as claimed in claim 1 wherein said grid system has a cell size and said ceiling panels are sized to correspond to the cell size.

5. In combination as claimed in claim 1 wherein said grid system defines a rectangular grid having a host of common sized cells and said ceiling panels are rectangular and of a size to cover one of the common sized cells of the rectangular grid and a portion of the main T's and cross T's defining the cell.

6. In combination as claimed in claim 5 wherein said first and second segments are interconnected by a bridge segment with said bridge segment overlying a junction of a main T and cross T of the grid system.

7. In combination as claimed in claim 6 wherein each ceiling panel has four torsion springs with each torsion spring hingedly secured at a corner of the ceiling panel and with each torsion spring releasably engaging a securing clip.

8. An alignment clip for a suspended ceiling system comprising a first channel adapted for engaging a flange edge of a grid member, a second channel opposite said first channel adapted for engaging an opposing flange edge of the respective grid member, and an alignment flange centrally disposed between said first and second channels adapted for engaging and centering adjacent ceiling panels, each alignment chip including curved segments which accommodate separation of said first and second channels while maintaining said alignment flange centered between said channels; wherein each of said channels is separated from said alignment flange by curved segments which project downwardly relative to said channels and are adapted to provide a ceiling panel stop surface separated from the lower surface of a grid member by a tool gap into which a hooked tool can pass and engage an upper surface of a ceiling panel secured therebelow.

9. An alignment clip as claimed in claim 8 wherein said second channel includes a cam member upwardly and outwardly disposed.

10. An alignment clip as claimed in claim 8 wherein said alignment flange is of a double thickness and can spread adjacent a base portion to increase the separation of said channels.

11. An alignment clip as claimed in claim 10 wherein said curved segments as adapted to distort to accommodate increases in the width of lower flanges of grid members.

12. An alignment clip as claimed in claim 11 wherein said clip is made of spring steel.

* * * * *